US006263600B1

(12) United States Patent
Brink

(10) Patent No.: US 6,263,600 B1
(45) Date of Patent: Jul. 24, 2001

(54) DISPLAY DEVICE

(76) Inventor: Carl Ten Brink, 17862 Metzler La., Huntington Beach, CA (US) 92647

( * ) Notice: Subject to any disclaimer, the term of this patent is extended or adjusted under 35 U.S.C. 154(b) by 0 days.

(21) Appl. No.: 09/161,133

(22) Filed: Sep. 25, 1998

(51) Int. Cl.[7] ..... G09F 13/24
(52) U.S. Cl. ..... 40/410; 40/409
(58) Field of Search ..... 40/409, 410

(56) References Cited

U.S. PATENT DOCUMENTS

| | | | | |
|---|---|---|---|---|
| 1,221,494 | | 4/1917 | Wiley . | |
| 2,361,423 | | 10/1944 | Snyder . | |
| 2,435,612 | | 2/1948 | Snyder . | |
| 2,543,606 | | 2/1951 | Solomon et al. . | |
| 2,587,620 | * | 3/1952 | Hormann | 40/409 |
| 3,999,750 | | 12/1976 | Perkins . | |
| 4,028,830 | | 6/1977 | Ottinger . | |
| 4,076,234 | | 2/1978 | Burnbaum . | |
| 4,641,445 | | 2/1987 | Rossi . | |
| 4,686,784 | | 8/1987 | Smithies . | |
| 4,817,311 | | 4/1989 | Ong . | |
| 4,962,922 | | 10/1990 | Chu . | |
| 5,092,065 | | 3/1992 | Teng . | |
| 5,098,084 | | 3/1992 | Culver . | |
| 5,110,636 | | 5/1992 | Hou . | |
| 5,200,239 | | 4/1993 | Chen . | |
| 5,261,848 | | 11/1993 | Kaplan et al. . | |
| 5,291,674 | | 3/1994 | Torrence . | |
| 5,313,727 | | 5/1994 | Murray, Jr. . | |
| 5,442,869 | | 8/1995 | McDarren et al. . | |
| 5,491,916 | | 2/1996 | Ingram et al. . | |
| 5,632,419 | | 5/1997 | Pickens . | |
| 5,666,750 | * | 9/1997 | Segan et al. | 40/409 |
| 5,737,860 | * | 4/1998 | Whigham et al. | 40/406 |
| 5,857,277 | * | 1/1999 | Mayze | 40/409 |

FOREIGN PATENT DOCUMENTS

| | | |
|---|---|---|
| 1083064 | 9/1967 | (GB) . |

* cited by examiner

*Primary Examiner*—Cassandra H. Davis
(74) *Attorney, Agent, or Firm*—Knobbe, Martens, Olson & Bear

(57) ABSTRACT

A device for moving elements in a fluid medium is disclosed. The device comprises a container filled with fluid and elements such as a plurality of small pellets which are dispersed in the fluid. The container is rotatably mounted within a chassis and a drive unit is used to rotate the container. One or more vanes are attached to an inner surface of the container to transport the elements within the containers. For example, if the elements simulate snowflakes which descend through the fluid towards the bottom portion of the container, the vanes trap or catch the snowflakes near the bottom of the container and move the snowflakes towards the top of the container. This creates a continuous, natural simulated snowfall with a natural appearance.

11 Claims, 4 Drawing Sheets

DISPLAY DEVICE

BACKGROUND OF THE INVENTION

1. Field of the Invention

This invention relates generally to a display device and, in particular, to a display device providing movement of a plurality of elements within a fluid.

2. Description of the Related Art

Conventional display devices commonly include a glass ball which is filled with fluid and attached to a base. A figure or sculpture is often located within the glass ball and small pellets or flakes are provided within the fluid. The glass ball is shaken to disperse the pellets throughout the fluid and the pellets then gradually descend through the fluid to the bottom of the glass ball, giving the appearance of falling snow. This known device has the obvious disadvantage that someone must shake it each time the appearance of falling snow is desired. Additionally, because all the pellets fall to the bottom of the device in a very short time period, the device must be repeatedly shaken—which is awkward, time-consuming and it can be a difficult task if the device is large or bulky. Additionally, if the person shaking the device does not cause the pellets to be unevenly distributed within the fluid, this creates a very artificial appearance because most of the pellets fall in the same area.

Other known snowfall display devices include internal impellers or pumps which cause the pellets or flakes to move within the fluid. These devices typically have an impeller located near the bottom of a glass container filled with fluid, and the impeller thrusts some of the fluid and particles upward while simultaneously drawing other fluid and particles downward. This creates a very artificial appearance because snowflakes do not move upward or in a circular manner during natural snowfall.

Another known snowfall display device includes a fluid filled tank with a small intake hole located near the bottom of the tank. Fluid and pellets are drawn into the intake hole by a pumping system, and the fluid and pellets are then pumped through a conduit to the top of the tank. Disadvantageously, because the fluid flow lines all terminate at the intake hole in the bottom of the tank, all the fluid and pellets flow towards this common point thus creating a very artificial appearance since all the snowflakes move towards one location.

SUMMARY OF THE INVENTION

A need therefore exists for a display device that is easy to use and provides movement of a plurality of elements within a fluid in a continuous, natural manner.

One aspect of the present invention is a display device which produces natural movement of a plurality of elements within a fluid. The device is arranged to provide for the even distribution of the elements within the fluid and one where the elements can move upwardly or downwardly according to the desired result. For example, the elements may move downwardly to simulate snowfall, or the elements may move upwardly to simulate rising bubbles. Advantageously the display device provides a natural, realistic movement of the elements within the fluid, while hiding the mechanism used to recirculate the elements.

Another aspect of the present invention is a display device which includes a chassis with a front side, a rear side and an opening, and a drive system connected to the chassis. A container with a generally circular outer surface and an interior space filled with fluid is positioned proximate the opening in the chassis. The drive system is used to rotate the container and this causes elements within the fluid to move from one portion of the container to another portion of the container.

Yet another aspect of the present invention is a display device that provides simulated snowfall within a container filled with fluid. A plurality of elements which simulate snowflakes are disposed in the fluid and the device is arranged so that the snowflakes move naturally downwardly under the force of gravity from the top portion of the container towards the bottom portion of the container. Advantageously, the display device moves the snowflakes from the bottom portion of the container to the top portion of the container along the periphery of the container to minimize any disruption of the natural looking snowfall.

Yet another aspect of the invention is a display device with a chassis, drive system and a container having one or more vanes connected proximate a peripheral edge of the container. The vanes are used to move the elements from the top portion to the bottom portion of the container, or vice versa, depending upon the desired use of the display device. The display device preferably includes a decorative covering which hides at least a portion of the chassis and/or the mechanism used to circulate the elements in the fluid and the display device preferably includes a background scene positioned behind the container so that it can be viewed through the container.

Still another aspect of the present invention is a display device which includes a container filled with fluid. The fluid contains a plurality of elements and the device includes a means for circulating the elements in the fluid.

Further objects, features and advantages of the present invention will become apparent from the detailed description of the drawings which follows, when considered with the attached figures.

BRIEF DESCRIPTION OF THE DRAWINGS

The appended drawings contain figures of preferred embodiments of the display device. The above-mentioned features of the display device, as well as other features, will be described in connection with the preferred embodiments; however, the illustrated embodiments are only intended to illustrate the invention and not limit the invention. The drawings contain the following figures.

DETAILED DESCRIPTION OF THE PREFERRED EMBODIMENTS

In accordance with the present invention, there is provided a display device which comprises a container for holding a fluid medium and a plurality of elements disposed therein, the display device is arranged so that the elements move naturally within the fluid. For example, the elements may move downwardly to simulate snowfall or the elements may move upwardly to simulate bubbles. Advantageously, as described below, the display device allows the elements to move naturally within the fluid and the display device hides or conceals the mechanism used to recirculate the elements.

To assist in the description of the components of the display device, words such as upward and downward are used to describe the accompanying figures and the movement of the elements through the fluid medium. It will be appreciated; however, that the present invention can be located in a variety of desired positions—including various angles, sideways and even upside down. A detailed description of the display device now follows.

Figure 1:
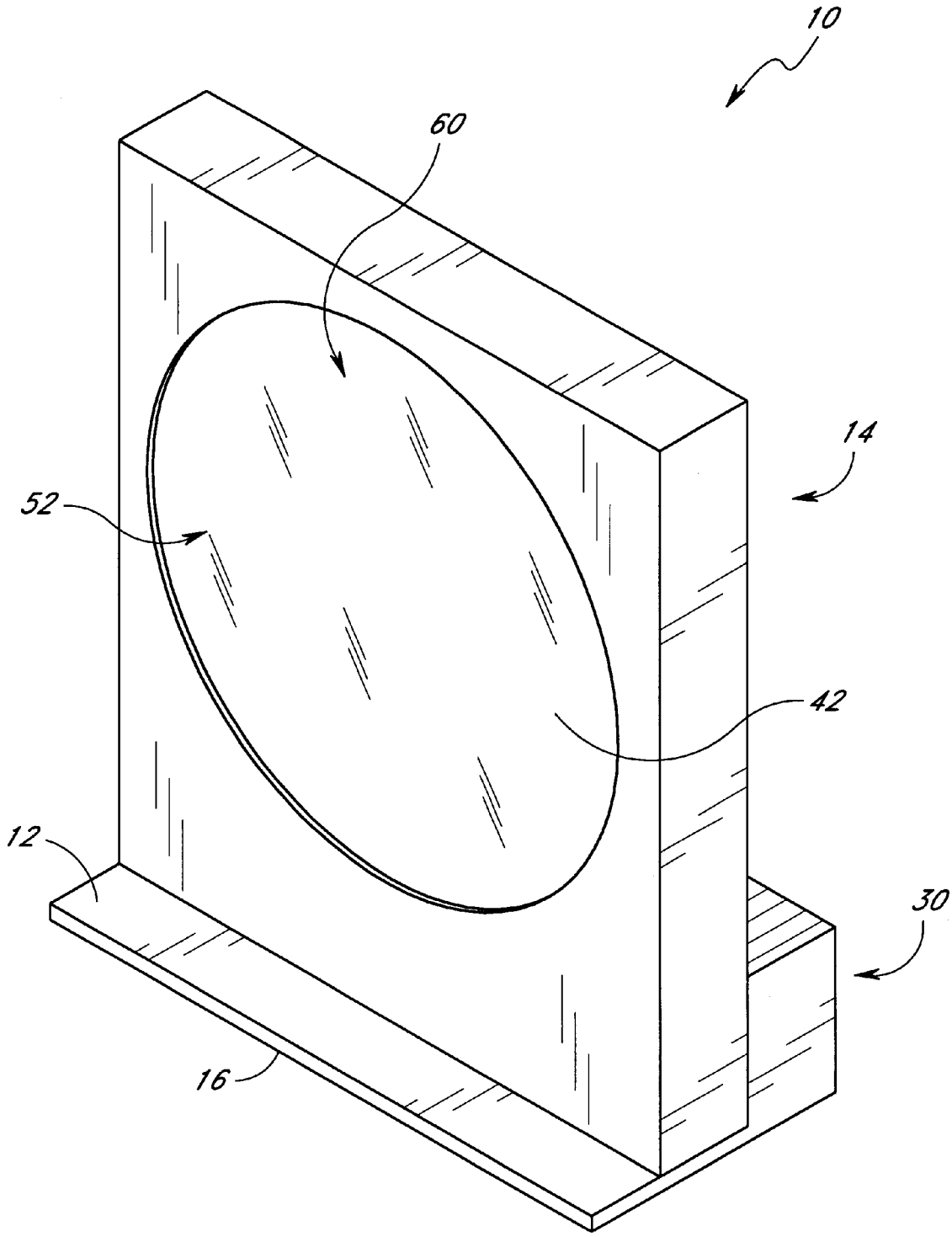
FIG. 1 is a perspective view of a display device of the present invention.

FIG. 1 illustrates a display device 10 constructed in accordance with a preferred embodiment of the present invention. The display device 10 includes a base 12, a chassis 14, a drive unit 30, a fluid medium 52 disposed within a container 42, and a plurality of elements 60 located within the fluid. The base 12 preferably has a planar lower surface 16 configured to support the display device 10 on a flat surface, but the base 12 may also be curved or have other types of desired shapes or configurations. Additionally, the device 10 may be designed to be supported in other manners such as hanging the device on a wall or mounting the device to various objects or surfaces.

Figure 2:
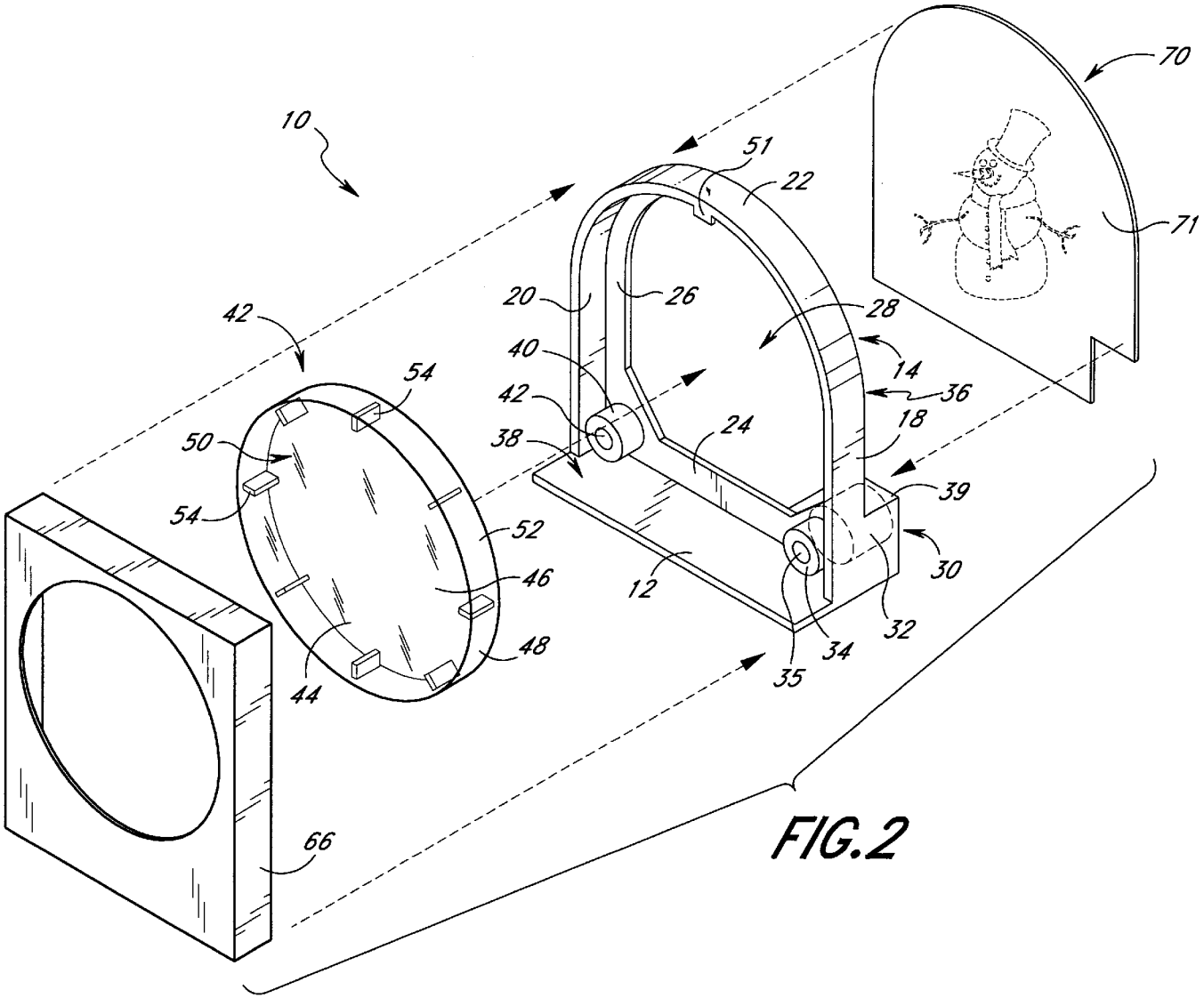
FIG. 2 is an exploded view of the display device of FIG. 1.

As seen in FIG. 2, the chassis 14 includes two generally upwardly extending side walls 18 and 20, and a curved upper section 22. Inwardly extending from the base 12, side walls 18 and 20, and curved upper section 22 is a lip 24 which forms a frame 26 defining a central opening 28. The chassis 14 is preferably constructed from plastic, but it may also be made from other materials such as wood, metal and the like. Additionally, the base 12 and chassis 14 may be integrally formed as a one-piece unit, or the base and chassis may comprise two or more separate pieces which are fastened together. The base 12 preferably has a length between about 4 inches and about 12 inches, and the chassis 14 preferably has a height between about 4 inches and about 12 inches, but one skilled in the art will recognize that the base and chassis may have any desired size and any desired configuration such as, but without limitation, rectangular, square, circular, or oblong.

Attached to the base 12 and/or chassis 14 is a drive unit 30 which includes a motor 32 (shown in phantom) and a drive wheel 34 connected to a shaft 35. The motor 32 can be powered by any desired power source, such as electrical or battery power, and the motor is used to rotate the drive wheel 34. The drive wheel 34 and shaft 35, for example, can be directly connected to the output shaft of the motor 32, or the drive wheel may be connected to the motor by any desired means such as shafts, gears, belts, chains and the like. The motor 32 is positioned on the back surface 36 of the chassis 14 so that it is generally hidden from a person viewing the display device 10 from a generally opposing front surface 38 of the chassis, and the motor is located within a housing 39 attached to the chassis 14. The drive wheel 34, which is positioned on the front side of the lip 24, is located slightly above the base 12 and the motor 32 can rotate the drive wheel in either a clockwise or counterclockwise direction, as desired. Additionally, the motor 32 and drive wheel 34 are generally aligned and positioned on the right side of the chassis 14, but it will be understood that the motor, drive wheel and other components of the drive unit 30 may be positioned in any desired location and configuration with respect to the chassis.

An idler wheel 40 is attached to the front surface of the lip 24, and the idler wheel is positioned slightly above the base 12. As illustrated, the idler wheel 40 is positioned on an opposite side of the chassis 14 from the drive wheel 34 and is generally horizontally aligned with the drive wheel 34, but the idler wheel may be placed in any desired location. In addition, the display device 10 may include more than one idler wheel. The idler wheel 40 freely rotates about a support shaft 42 connected to the chassis. The idler wheel may also be rotated or driven by a motors such as the motor 32 of the drive unit 30 or a separate motor as will be easily understood by those skilled in the art.

The display device 10 also includes a container 42 which is configured to fit within the chassis 14 proximate the central opening 28 in the frame 26. The container 42 is preferably positioned on the front surface 38 of the chassis 14, but it may also be located on the back surface 36. The container 42 includes a front surface 44, a rear surface 46, a side wall 48 and an interior space 50. The side wall 48 preferably has a generally circular outer exterior surface and the side wall is configured to engage or contact the drive wheel 34 and idler wheel 40. Alternatively, the side wall 46 may be connected to the drive wheel 34 and/or idler wheel 40 by a belt, chain, gear or other known means.

In the preferred embodiment, the distance between the front surface 44 and the rear surface 46 of the container 42 is between about ¼" to ¾" inches, but the distance can be larger or smaller. The diameter of the container 42 is sized to allow the container to fit within the chassis 14 and to allow the side wall 48 to contact the wheels 34 and 40. Additionally, the container 42 is preferably sized slightly larger than the frame 26 so that the frame helps position the container in the desired location. One or more flanges 51 extending inwardly from the chassis 14 may also be used to position the container 42 in the desired location. The diameter of the container 42 can vary. Those of skill in the art will appreciate that the exact shape and dimensions of the container 42 may vary according, for example, to the desired size of the display device 10 and chassis 14.

The front and rear surfaces 44, 46 of the container 42 are preferably constructed from a translucent or clear material such as glass or plastic, but the container may be made from any desired materials and the container may have different colors, shapes and patterns. The front and rear surfaces 44, 46 of the container 42 may be convex to magnify or enlarge the contents of the container 42, or the surfaces may also be generally planar or concave.

A fluid medium 52 is contained within the interior space 50 defined by the container 42. In a preferred embodiment, the fluid medium 52 comprises water, but other liquids which are sufficiently translucent may also be utilized. Although not shown in the accompanying drawings, the container 42 includes an opening which allows the container to be filled. The opening may be permanently sealed or the opening may allow the container to be drained and refilled.

Figure 4:
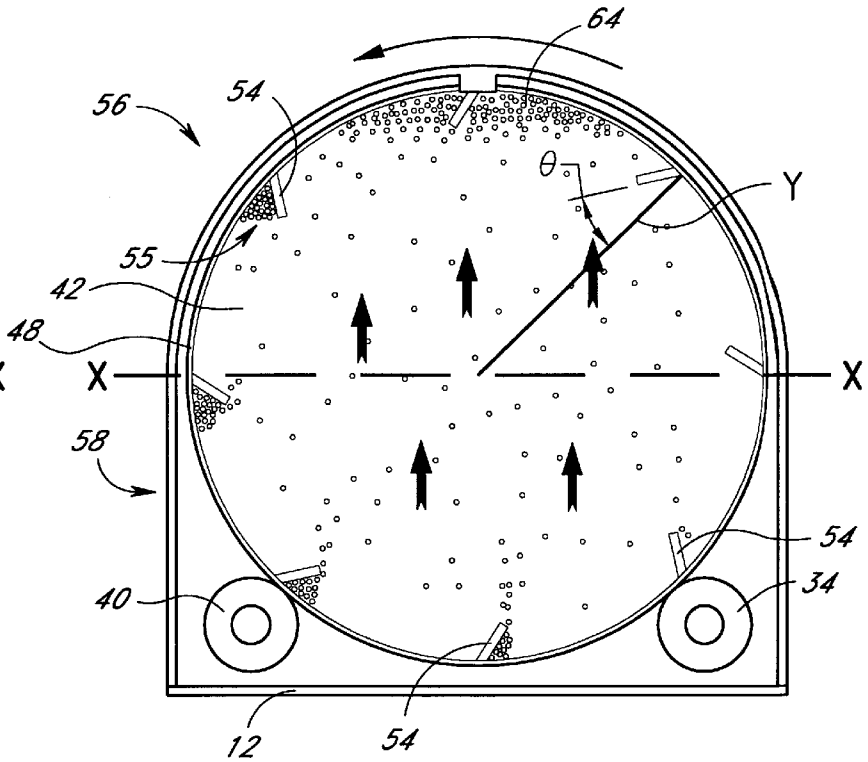
FIG. 4 is a front view of the display device of FIG. 1, illustrating the upward movement of elements through the display device.
Figure 3:
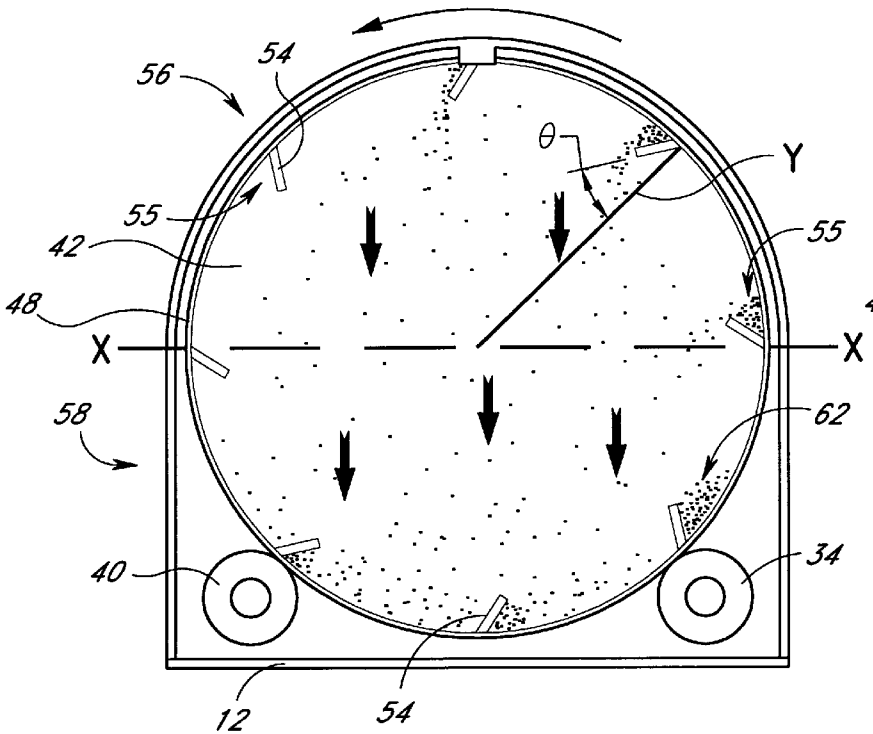
FIG. 3 is a front view of the display device of FIG. 1, illustrating the downward movement of elements through the display device.

To further assist in the description of the display device 10, the following coordinate terms are used. As shown in FIGS. 3 and 4, a longitudinal axis X—X extends through the center of the container 42 and this axis divides the container into an upper portion 56 and a lower portion 58, and a line Y extends radially outward from the center of the container 42 towards the side wall 48 of the container 42.

As best seen in FIGS. 3 and 4, one or more inwardly extending vanes or baffles 54 are located within the container 42. Eight exemplary vanes 54 are shown in the accompanying figures at generally equally spaced intervals, but any number of vanes, including no vanes, may be used and the vanes may be spaced at any desired interval. The vanes 54 are attached to the inner surface of the side wall 48 and/or to the inner surfaces of the front and rear surfaces 44, 46 of the container 42. Alternatively, the vanes 54 may be spaced from the side wall 48 or positioned in other locations within the container 42. The vanes 54 may be aligned with the radially outward extending line Y, or the vanes may be at an angle θ relative to the line Y. Preferably, the vanes are located at an angle θ between about 90° and 45° and, more preferably, at an angle of about 60°, but the vanes may be at any desired angle. The vanes 54 advantageously form a pocket 55 with the inner surface of the side wall 48 of the container 42.

Instead of vanes 54, the inside surface of the container 42 may be formed with pockets or raises for trapping the elements 60, as described below.

Distributed within the fluid medium 52 are a plurality of elements 60. In one preferred embodiment of the present invention, as shown in FIG. 3, the elements 60 comprise simulated snowflakes 62. The snowflakes 62 may include small white flakes or pellets which resemble snow. The snowflakes 62 have a higher specific gravity than the fluid medium 52 so that gravity forces the snowflakes to descend downwardly through the fluid. Desirably, the snowflakes 62 descend through the fluid 52 at a rate which is approximately equal to the descent rate of an actual snowflake through air. To achieve this result, the type of fluid medium 52 and snowflakes 62 must be chosen such that the snowflakes have a generally slightly greater specific gravity than the fluid medium. For example, the fluid 52 may comprise water and the snowflakes 62 may comprise pellets of a polymer material such as polyvinylchloride (typically known as PVC), but other types of materials and fluids may also be readily used.

In another preferred embodiment of the present invention, as shown in FIG. 4, the elements 60 may comprise bubbles or other materials 64 which have a specific gravity lower than the fluid medium 52 so that the bubbles move upwardly through the fluid. The bubbles 64 and fluid medium 52 may be selected, for instance, to allow the bubbles to quickly rise through the fluid, or the bubbles may float slowly upwardly through the fluid. It will be understood by one skilled in the art that the bubbles 64 may comprise, for example, but without limitation, air bubbles, hollow objects or solid objects which have a specific gravity lower than the fluid medium 52.

As seen in FIGS. 3 and 4, the containers 42 rotate in a counter-clockwise motion, but the container may also rotate in a clockwise motion. It will be appreciated that the size and angle θ of the vanes 54 may vary according, for example, to the speed and direction of rotation of the container 42. Preferably, the container 42 is rotated at a rate which has minimal, if any, impact on the elements 60 moving through the center portion of the container.

As best seen in FIG. 2, the display device 10 also includes a foreground 66. The foreground 66 is attached to the base 12 and/or chassis 14 by any known means, such as screws, bolts, clips or magnets, and the foreground provides a pleasing aesthetic covering to the display device 10. The foreground 66 desirably covers at least a portion of the chassis 14 and, more desirably, the foreground covers the chassis, drive system 30 and vanes 54 such that only the desired center portion of the container 42 is visible to a viewer. For example, the foreground 66 may form wreath or a picture frame, but it will be appreciated that the foreground may have any desired shape, size, design or configuration.

The display device 10 may also include a light source (not shown in them accompanying figures) for illuminating the elements 60 and making them more readily visible as they move through the fluid 52. This light source preferably comprises an electrically powered light which is removably secured to the chassis 14. The light source projects light into the container 42, causing light to reflect off of the elements 60, thereby highlighting the elements and further enhancing the aesthetic appearance of the device. The light source also preferably serves to highlight a background or decorative scene 70 which may be positioned to be viewed in connection with the container 42.

As seen in FIG. 2, in the preferred embodiment, the decorative scene 70 comprises a figure or drawing (shown in phantom for illustrative purposes only) on a panel 71, but the decorative scene may also include three-dimensional figures, sculptures, photographs, graphics, artistic renderings, and the like. The decorative scene 70 is positioned proximate the back side 36 of the chassis 14 and the decorative scene may be permanently or removably attached to the chassis 14. For example, as seen in FIG. 2, the panel 71 includes a picture of a snowman for use in connection with the snowflakes 62.

Figure 5B:
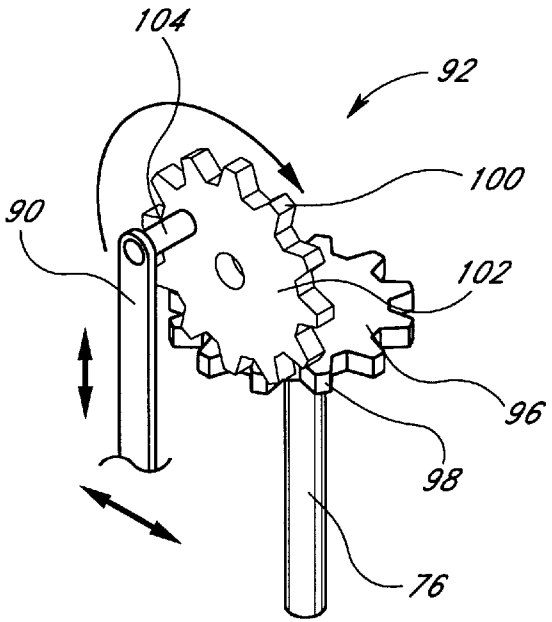
FIG. 5B is an enlarged perspective view of a portion of the display device of FIG. 5A.
Figure 5A:
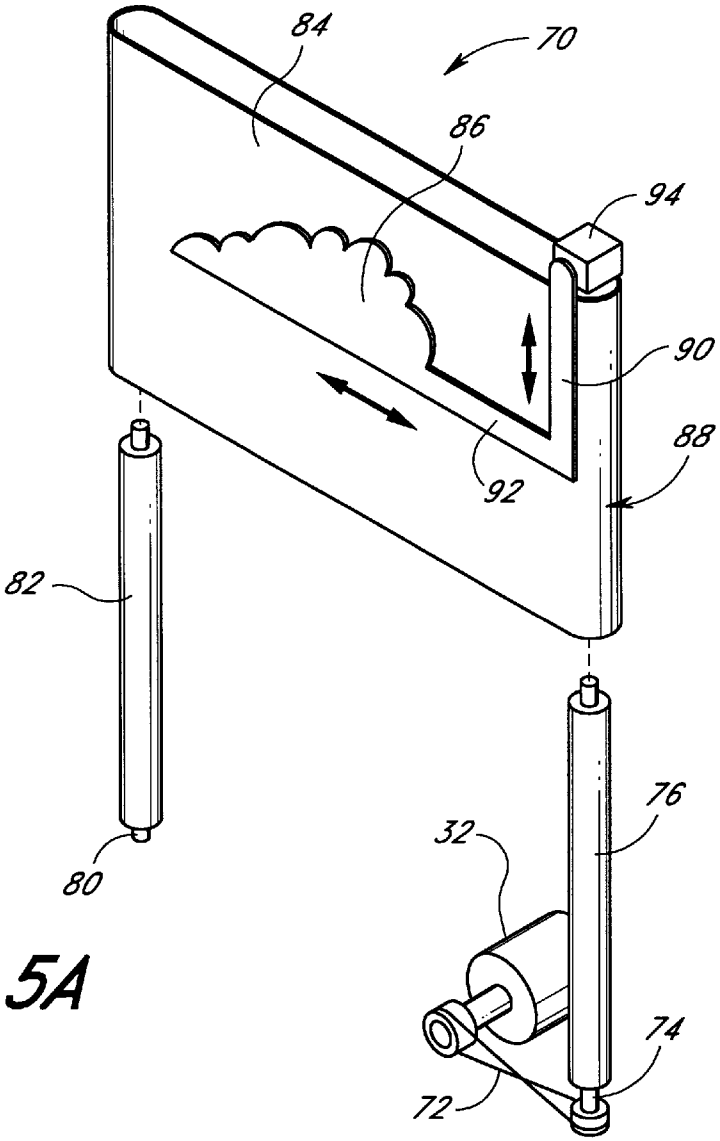
FIG. 5A is a perspective view of an alternative embodiment of the background of the display device of the present invention.

As seen in FIG. 5A, in another preferred embodiment, the decorative scene 70 may also be movable. The motor 32 may be connected by a belt 72 or other flexible drive element 72 to a generally upwardly extending shaft 74. The shaft 74 is pivotably mounted to the chassis 14 and includes a roller 76. Also pivotably mounted to the chassis 14 is a second shaft 80 with a roller 82. A flexible screen 84 is mounted on the rollers 76, 82 such that when the rollers rotate, the screen 84 moves. It will be understood that the screen 84 may be moved at any desired rate and the screen may have any desired pictures, graphics and the like.

The decorative scene 70 may also include a figure 86 positioned in front of the screen 84. The figure 86 is held in position by an arm 88 which has a first part 90 and a second part 92 joined at approximately a 90° angle, but the arm could have any number of parts joined at any desired angle. In one embodiment, the arm 88 may be transparent so as not to be seen through the container 42. The figure 86 is preferably mounted such that it can move horizontally and/or vertically in front of the screen 84, but the figure can also be located in a fixed location. In the preferred embodiment, the figure 86 moves because the arm 88 is connected to the top of the shaft 74 by one or more gears located within a housing 92. The figure 86 may comprise any type of desired design, symbol, pattern, etc.

As shown in FIG. 5B, a first gear 96 is mounted generally horizontally to the upper portion of the shaft 74 and the teeth 98 of the first gear are configured to engage the teeth 100 of a second gear 102. The first and second gears 96, 102 are preferably positioned at about a 90° angle, but the gears can be located at any desired angle. A rod 104 is connected to the gear 102 and the first part 90 of the arm 88 is pivotably connected to the rod 104. The rotation of the shaft 74 causes the first and second gears 96, 102 to rotate causing the rod 104 to move in a generally circular pattern. Because the figure 86 is connected to the rod 104 by the arm 88, the figure 86 moves horizontally and vertically in front of the screen 84. One skilled in the art will understand that the gears may be of different sizes, shapes and configurations, and the gears may be located in a variety of different configurations to provide the desired movement of the arm 88 and FIG. 86. Additionally, it will also be appreciated that cams, pinions, sprockets, chains, belts, lines, etc. may also be used to connect the arm 88 to the shaft 74, and the device may be configured to move the figure 86 in any desired pattern or motion.

In operation, the motor 32 rotates the drive wheel 34, which engages the outer surface of the side wall 48, thus rotating the container 42. The container 42 is rotated slowly so that the fluid 52 in the center of the container is not unnecessarily agitated and large flow patterns are not unnecessarily created in the fluid. This allows the elements 60 to move in a natural, realistic manner through the fluid 52. For example, as seen in FIG. 3, the snowflakes 62 gradually descend through the fluid 52 toward the bottom of the container 42 because of their higher specific gravity. The rotating vanes 54 trap or catch the snowflakes 62 in the pocket 55 in the lower portion 58 of the container 42 and, as the container 42 rotates, the snowflakes are brought towards the upper portion 56 of the device. As the vanes 54 cross the horizontal axis X—X, the snowflakes 62 begin to tumble or fall out of the pocket 55 and these flakes begin, to descend into the lower portion 58 of the container. The snowflakes 62 continue to fall out of the pocket as the container rotates through the upper portion 56. Advantageously, the vanes 54 are desirably positioned at an angle θ to allow the snowflakes 62 to fall in a generally uniform manner to create a natural looking snowfall. The cycle is repeated as the container 42 continues to rotate between the upper and lower portions.

On the other hand, as seen in FIG. 4, if the elements 60 are bubbles 64, which have a lower specific gravity than the fluid 52, the bubbles gradually ascend through the fluid towards the upper portion 56 of the container 42. The pockets 55 created by the vanes 54 collect the bubbles 64 in the upper portion 56 of the container and the rotating vanes bring the bubbles to the lower portion 58 of the container. Significantly, the vanes distribute the bubbles 64 in a uniform manner through the fluid 52 to create an aesthetically pleasing display. The cycle continues to repeat itself as the container continues to rotate.

A viewer looking through the front surface 44 of the container 42 thus sees the elements 60 distributed within the fluid 52 and the viewer can see the decorative scene 70 which may be fixed to panel 71 or the moving screen 84. Advantageously, the moving elements 60 and decorative scene 70 create an aesthetically pleasing display. Additionally, the foreground 66, which preferably hides at least a portion of the chassis 14 and the vanes 54 in the container 42, further may enhance the appearance of the display.

Although this invention has been described in terms of certain preferred embodiments, other embodiments apparent to those of ordinary skill in the art are also within the scope of this invention. Accordingly, the scope of the invention is intended to be defined only by claims which follow.

I claim:

1. A display device which enables a plurality of elements to move in a fluid medium, comprising:

a substantially vertical chassis member having a front surface, a rear surface and an opening;

a drive system connected to the chassis, the drive system including a motor and a drive wheel, the motor configured to rotate the drive wheel, the drive wheel being located on the front surface of the chassis member and the motor being located on the rear surface of the chassis member; and a container positioned proximate the opening in the chassis, the container having an interior space filled with the fluid medium and the plurality of elements, the container adapted to provide a substantially straight vertical flow path between a first point adjacent a perimeter of the container and a second point adjacent the perimeter and opposite the first point, the flow path being unimpeded by any solid object, wherein the drive system rotates the container to provide movement of the elements in the fluid.

2. A display device which enables a plurality of elements to move in a fluid medium, comprising:

a substantially vertical chassis member having a front surface, a rear surface and an opening;

a drive system connected to the chassis, the drive system including a motor and a drive wheel, the motor configured to rotate the drive wheel;

a container positioned proximate the opening in the chassis, the container having an interior space filled with the fluid medium and the plurality of elements, the container adapted to provide a substantially straight vertical flow path between a first point adjacent a perimeter of the container and a second point adjacent the perimeter and opposite the first point, the flow path being unimpeded by any solid object, wherein the drive system rotates the container to provide movement of the elements in the fluid; and a background located proximate to the rear surface of the chassis member, the background configured to be removable and to be viewable through the container.

3. The display device of claim 2, further comprising a design located between the background and at least a portion of the container.

4. The display device of claim 3, further comprising a design located between the background and the container, wherein the design is configured to be viewable through the container.

5. A display device which enables a plurality of elements to move in a fluid medium, comprising:

a chassis having a front surface and a rear surface;

a drive system attached to the chassis, the drive system having a motor, a drive wheel and an idler wheel, the motor connected to the drive wheel;

a container enclosing an interior space and having a plurality of vanes connected proximate a peripheral edge of the container, the interior space being substantially clear of obstructions so that an element traveling along a straight path from a top portion of the edge to a bottom portion of the edge is not diverted by any solid object; wherein the container is rotated by the drive wheel and the vanes are configured to move the elements within the container; and a background located proximate to the rear surface of the chassis, at least a portion of the background adapted to be viewable through the container from the front surface toward the rear surface, wherein the background comprises a screen mounted to a pair of rollers.

6. The display device of claim 5, wherein at least one of the rollers is connected to the motor and wherein the motor causes the roller to rotate, wherein the rotating roller causes the screen to move.

7. A display device which enables a plurality of elements to move in a fluid medium, comprising:

a chassis having a front surface and a rear surface;

a drive system attached to the chassis, the drive system having a motor, a drive wheel and an idler wheel, the motor connected to the drive wheel;

a container enclosing an interior space and having a plurality of vanes connected proximate a peripheral edge of the container, the interior space being substantially clear of obstructions so that an element traveling along a straight path from a top portion of the edge to a bottom portion of the edge is not diverted by any solid object, wherein the container is rotated by the drive wheel and the vanes are configured to move the elements within the container;

a background located proximate to the rear surface of the chassis, at least a portion of the background adapted to be viewable through the container from the front surface toward the rear surface; and a design located between the screen and at least a portion of the container.

8. A display device which enables a plurality of elements to move in a fluid, comprising:

a chassis having a front surface, a rear surface and an opening;

a container positioned proximate the opening in the chassis, the container having an interior space filled with the fluid and the plurality of elements, the container having an axis of rotation and being substantially symmetrical about a plane defined perpendicular to the axis of rotation; and a drive system connected to the container, wherein the drive system rotates the container about the axis of rotation to provide movement of the elements in the fluid, wherein the drive system includes a motor and an untoothed drive wheel, and wherein the motor is configured to rotate the untoothed drive wheel.

9. A display device which enables a plurality of elements to move in a fluid medium, comprising:

a chassis having a front surface and a rear surface;

a drive system secured to the chassis, the drive system having a motor, a drive wheel and an idler wheel, the motor connected to the drive wheel;

a container having one or more vanes connected proximate a peripheral edge of the container; and a background located proximate to the rear surface of the chassis, at least a portion of the background adapted to be viewable through the container from the front surface toward the rear surface, the background comprising a screen mounted to a pair of rollers, wherein the container is rotated by the drive wheel and the vanes are configured to move the elements within the container, wherein at least one of the rollers is connected to the motor and the motor causes the roller to rotate, and wherein the rotating roller causes the screen to move.

10. A display device which enables a plurality of elements to move in a fluid medium, comprising:

a chassis having a front surface and a rear surface;

a drive system secured to the chassis, the drive system having a motor, a drive wheel and an idler wheel, the motor connected to the drive wheel;

a container having one or more vanes connected proximate a peripheral edge of the container; and a background located proximate to the rear surface of the chassis, at least a portion of the background adapted to be viewable through the container from the front surface toward the rear surface, the background comprising a screen mounted to a pair of rollers; wherein the container is rotated by the drive wheel and the vanes are configured to move the elements within the container, and wherein the background additionally comprises a figure positioned in front of the screen.

11. The display device of claim 10, wherein the figure is held in position by a substantially transparent arm.

* * * * *